US006180149B1

(12) United States Patent
Gramm

(10) Patent No.: US 6,180,149 B1
(45) Date of Patent: Jan. 30, 2001

(54) METHOD OF RECONSTITUTING FROZEN AND POWDERED DRINKS

(76) Inventor: Jeffrey S. Gramm, 8013 Old Deer Trail, Raleigh, NC (US) 27615

( * ) Notice: Under 35 U.S.C. 154(b), the term of this patent shall be extended for 0 days.

(21) Appl. No.: 09/197,871

(22) Filed: Nov. 23, 1998

(51) Int. Cl.[7] ..... B65B 29/06

(52) U.S. Cl. ..... 426/394; 426/392; 426/397; 426/506; 426/87; 426/112; 426/124

(58) Field of Search ..... 426/112, 120, 426/115, 124, 106, 131, 394, 397, 506, 392, 87; 215/DIG. 8, 10, 6, 231, 386; 220/501, 502

(56) References Cited

U.S. PATENT DOCUMENTS

| | | | | |
|---|---|---|---|---|
| 1,609,447 | * | 12/1926 | Ward . | |
| 2,019,565 | * | 11/1935 | Fulton et al. | 215/10 |
| 2,385,648 | * | 9/1945 | Prager | 215/DIG. 8 |
| 2,631,521 | * | 3/1953 | Atkins | 426/120 |
| 2,824,010 | * | 2/1958 | Pedersen | 426/120 |
| 3,144,931 | * | 8/1964 | Long | 426/112 |
| 3,156,352 | * | 11/1964 | Hayhurst | 426/115 |
| 3,156,369 | * | 11/1964 | Bowes et al. | 215/DIG. 8 |
| 3,163,544 | * | 12/1964 | Valyi . | |
| 3,458,076 | * | 7/1969 | Babcock | 215/DIG. 8 |
| 3,533,807 | * | 10/1970 | Wakefield | 426/112 |
| 3,613,955 | * | 10/1971 | Wetherell | 215/DIG. 8 |
| 3,720,522 | * | 3/1973 | Nakagami | 426/120 |
| 3,851,860 | * | 12/1974 | Smith . | |
| 3,856,138 | * | 12/1974 | Maekawa et al. | 426/112 |
| 3,920,226 | * | 11/1975 | Walt . | |
| 4,614,437 | * | 9/1986 | Buehler | 215/6 |
| 4,779,991 | * | 10/1988 | Kitamura et al. | 215/DIG. 8 |
| 4,844,917 | * | 7/1989 | Delorimiere | 426/112 |
| 4,873,100 | * | 10/1989 | Dirksing et al. | 426/112 |
| 5,000,314 | * | 3/1991 | Fuller et al. | 215/DIG. 8 |
| 5,114,011 | * | 5/1992 | Robbins | 215/10 |
| 5,197,602 | * | 3/1993 | Biesecker et al. | 215/10 |
| 5,209,565 | * | 5/1993 | Goncalves | 215/DIG. 8 |
| 5,370,222 | * | 12/1994 | Steigerwald et al. | 215/DIG. 8 |

FOREIGN PATENT DOCUMENTS

| | | | | |
|---|---|---|---|---|
| 704569 | * | 3/1965 | (CA) | 426/112 |
| 2227004 | * | 7/1990 | (GB) | 426/112 |
| 598344 | * | 9/1959 | (IT) | 220/501 |

* cited by examiner

*Primary Examiner*—Steven Weinstein
(74) *Attorney, Agent, or Firm*—Mills Law Firm PLLC

(57) ABSTRACT

A bottled water contained system for admixture of frozen juice and powdered drink concentrates is disclosed. This invention provides a plurality of plastic containers including bottled water from an identifiable commercial source of a volume which is less than the total volume of the container. The admixture of the concentrate in frozen, liquid, or powdered form provides a reconstituted fruit drink of a volume which fills the container to capacity. In one embodiment a bottled water container generally in the form of a pitcher is provided with a mouth opening which is dimensioned to receive a standard-sized can of frozen juice concentrate. In an alternative embodiment the bottled water container is provided with a cup-shaped insert which resides in the mouth opening of the container to give the appearance of a full container. The insert has a volume equal to the volume of a standard-sized can of frozen juice concentrate which is added to the container after the insert is removed. In yet another embodiment the container is provided with a wide-mouth opening to permit the convenient transfer of a powdered drink concentrate therein for reconstitution. The present bottled water container system provides the consumer with the choice of a brand name water for admixture to the frozen or powdered concentrate.

2 Claims, 3 Drawing Sheets

METHOD OF RECONSTITUTING FROZEN AND POWDERED DRINKS

BACKGROUND OF INVENTION

1. Field of Invention

This invention relates generally to containers and, more particularly, to a method for mixing frozen, liquid and powdered juice concentrates with containers of bottled water.

Many different methods of preparing frozen, liquid and powdered juice concentrates are known in the prior art. In general, the mixing procedure tends to be messy and inconvenient. In the case of frozen juice concentrates, the concentrate must first be removed from its container by the use of kitchen utensils and placed in a pitcher for mixing. Thereafter, water is added from the faucet or from a bottled water dispenser to provide the desired mixture. Typically, the mess occurs when removing stirring utensils from the pitcher and when attempting break down the frozen chunks of concentrate with a spoon while mixing.

In the case of powdered concentrates, the problems are similar requiring the transfer of the powdered material into the pitcher or other mixing container. The powder is easily spilled and is difficult to clean up.

In either procedure, mixing the proper quantity of water with the concentrate is also an inconvenience. Deviation from the prescribed formula or failure to completely mix the ingredients results in juice that doesn't taste quite right.

The present invention has been developed to reduce the mess and inconvenience encountered when preparing frozen, liquid and powdered juice concentrates and to provide the consumer with a reconstituted juice of a consistent quality and taste.

2. Description of Related of Prior Art

U.S. Pat. No. 3,851,860 to Larry Charles Smith discloses a pitcher having a receptacle adapted to receive a container of frozen juice concentrate. The open container is left in the receptacle with the open end down while the concentrate is allowed to fall and flow into the main chamber of the pitcher.

U.S. Pat. No. 4,264,007 to Guilbert M. Hunt discloses a container having separate storage facilities for two materials and the admixing of the materials upon opening of the container. A main container holds a quantity of a first material, such as carbonated water, and a separate compartment holds a small quantity of a second material, such as a sweetener flavoring, which is added when the container is opened.

U.S. Pat. No. 3,163,544 to Emery I. Valyi discloses a container for fluids and granulated materials in which a sealable, substantially fluid tight, collapsible bag of pliable material is disposed within an outer container having greater strength but necessarily in itself fluid tight. In one embodiment of this invention for dispensing frozen juices, the bag may be held in a disposable box of the size of the frozen product. For use the bag is removed from this box and placed in a container of the size required to hold the water for which the product is to be mixed.

U.S. Pat. No. 3,920,226 to Robert Alan Walt disclosed a combination frozen juice remover, mixer and container for removing frozen juice from a container and mixing the same with a liquid in a receptacle including a receptacle having a bottom with a rigid rectangular shaped blade having a helical twist and secured to the bottom of the receptacle.

U.S. Pat. No. 3,741,383 to John C. Wittwer discloses a unitary container having a frangible inner compartment for storing a liquid and a non-liquid or two incompatible materials one of which has solvent properties. The materials are normally separated in the container and can be mixed when desired.

U.S. Pat. No. 3,362,530 to Wesley N. Johnson discloses a container having a off-center neck opening adapted to contain at least two resilient tubular sleeve members friction fitted within the container. These sleeve members are adapted to carry a plurality of tablets or wafers in coin-stacked engagement. This construction prevents the tablets or wafers from striking against each other or the interior of the container.

U.S. Pat. No. 1,609,447 to Neil C. Ward discloses a multiple celled container or compartment bottle in which several compartments containing isolated ingredients can be simultaneously sealed until ready for admixture.

U.S. Pat. No. 832,168 to Siegfried Schopflocher discloses a receptacle for paints or other mixtures liable to deterioration which keeps the ingredients separate until the mixture is to be used. The receptacle includes a destructible cup suspended from the top edge of the can or jar and a stopper engaging the upper edge of the cup.

U.S. Pat. No. 3,450,254 to Gilbert D. Miles is considered of general interest in that it discloses a package and receptacle having an inner portion which is fitted internally of the exterior receptacle in spaced relation thereto. Either the inner portion or the space defined between the inner portion and the receptacle is filled with a liquid having the ability to leach out the ingredient container within the inner portion.

Finally, U.S. Pat. No. 730,337 to Martin Bonnefont is considered of general interest in that it discloses a nursing bottle containing a removable bottom portion having a chamber formed therein in which a block of previously heated stone can be inserted which will maintain the temperature of the milk for a long time.

SUMMARY OF THE INVENTION

After study of the above hereinabove described problems, the present invention has been developed to provide a bottled water container system and method of reconstituting and mixing of frozen, liquid and powdered drink concentrates. The present system comprises a plurality of bottled water containers of the type generally sold in grocery stores containing a pre-measured volume of water. In accordance with the present method a container of frozen juice concentrate or powdered concentrate of a known volume is added in order to fill the container to capacity and reconstitute the juice or flavored drink.

In one embodiment the bottled water container contains a mouth opening configured to slidingly receive a standard frozen or liquid juice concentrate container enabling the contents thereof to flow into the bottled water container and fill it to capacity.

In another embodiment the bottled water container including a pre-measured volume of processed water is provided with a so-called wide-mouth opening to permit the addition of a powdered drink concentrate of a known volume.

In yet another embodiment a bottled water container is provided with a cup-shaped insert substantially identical in size to a frozen juice concentrate container which serves to maintain the desired volume taken up by the addition of the frozen juice concentrate and to give the appearance of a full container.

In any case, the partially filled bottled water container of the present system including water from a commercial distributor are sealed and distributed for retail sale to permit the consumer to reconstitute the frozen juice and powdered drink products using water from a known commercial source.

In view of the above it is an object of the present invention to provide a method for conveniently mixing frozen or liquid juice and powdered drink concentrates with a prepackaged volume of bottled water to constitute the juice or flavored drink.

Another object of the present invention is to provide a plurality of bottled water containers which are constructed to receive canisters of frozen or liquid juice concentrate within a mouth opening thereof.

Another object of the present invention is to provide prepackaged bottled water containers having a so-called wide mouth opening formed therein to facilitate the transfer of powdered concentrates of a predetermined quantity therein for reconstitution thereof.

Another object of the present invention is to provide the consumer with prepackaged bottled water containers including a predetermined volume of water from a known commercial source for reconstituting frozen juice and powdered drink concentrates.

Another object of the present invention is to provide a prepackaged bottled water container including a generally cup-shaped insert approximating the volume of a canister of frozen juice concentrate to insure the volume of the reconstituted juice does not exceed the capacity of the bottle water container.

Other objects and advantages of the present invention will become apparent and obvious from a study of the following description and the accompanying drawings which are merely illustrative of such invention.

DETAILED DESCRIPTION OF THE PREFERRED EMBODIMENT

Figure 1:
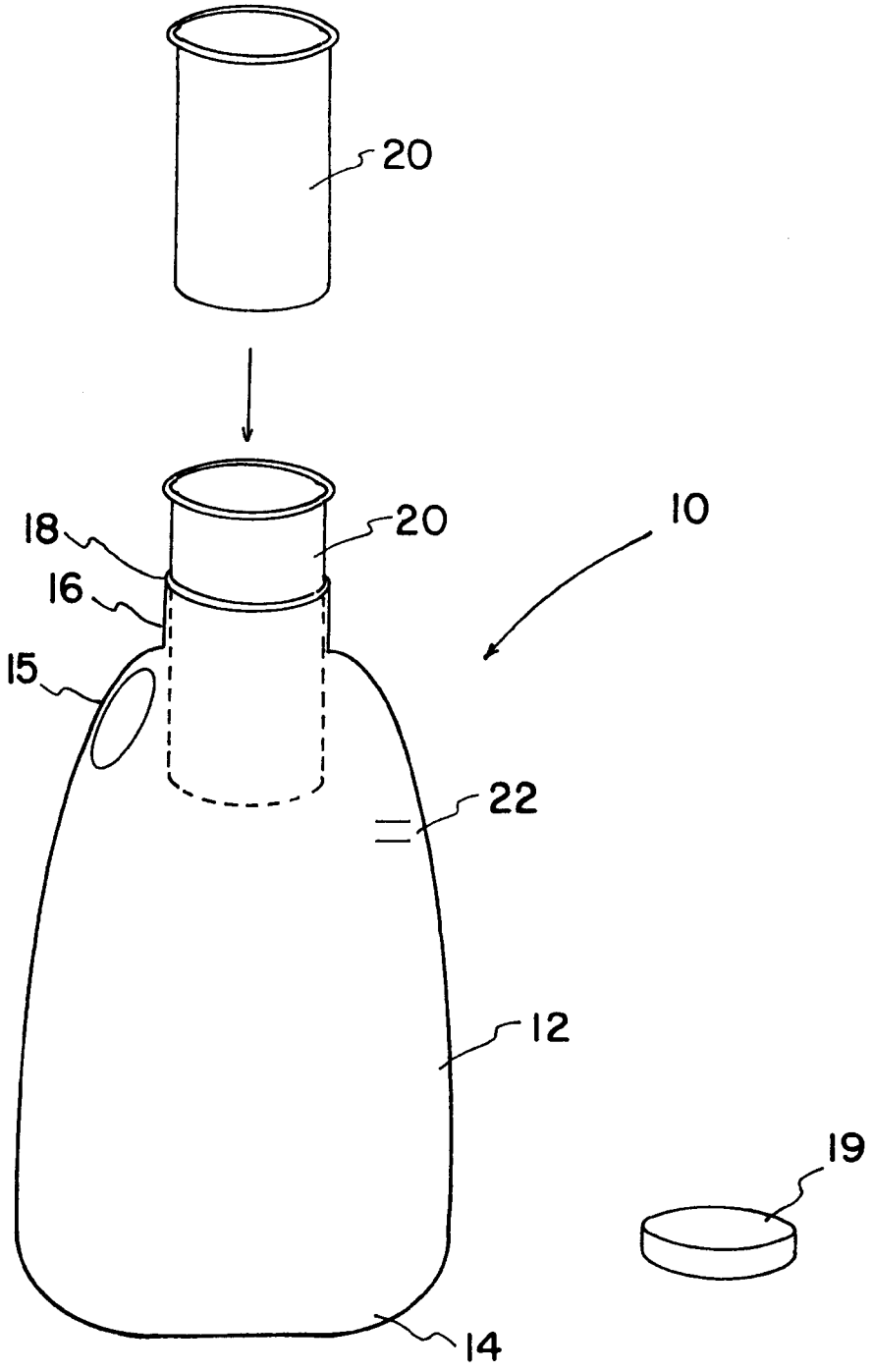
FIG. 1 is a perspective view of one preferred embodiment of a bottled water container of the invention.

With further reference to the drawings, there is shown therein one preferred embodiment of a bottled water container in accordance with the present invention, indicated generally at 10 and illustrated in FIG. 1.

For purposes of the present application, the term "bottled water" refers to a factory sealed container identifiable to a commercial source. Bottled waters sold under the trade name Sparkletts, Culligan as well as numerous other brand names encountered on grocery store shelves are suitable for use with the present invention.

In the preferred embodiment, the container 10 is constructed of a plastic material having suitable characteristics for gas sterilization or other sterilization processes known in the bottling industry.

The overall construction of the container 10 includes a generally square to cylindrical shaped body portion 12 having a bottom surface 14, an integrally formed handle 15, a tapered neck portion 16, and a cylindrical mouth opening 18. A resealable cap 19 is also provided to cover the opening 18.

In accordance with the present invention the mouth opening 18 is dimensioned to slidingly receive a standard 12 ounce frozen juice concentrate can 20. At the present date virtually all frozen juice concentrate cans have an outside diameter of $2^{11}/_{16}$ inches.

Thus, the mouth opening 18 is formed to an inside diameter which is slightly larger than this dimension to permit the can 20 to be inserted into the opening 18 as shown in phantom outline in FIG. 1 and reside therein.

Because the insertion of the can 20 filled with frozen concentrate displaces an equivalent volume of water in the container 10, the present invention provides a container 10 having a predetermined volume of bottled water therein which is less than the full capacity of the container by the volume of the can 20. When combined with the volume of frozen concentrate within the can 20 the container is filled to capacity with reconstituted juice.

The container 10 may be provided with indicia 22 thereon to provide a water level mark indicating the level to which it is to be filled during packaging.

More particularly, the container 10 is provided in different sizes and capacities for reconstituting the frozen juices of different manufacturers. For example, a container 10 or Ready-Mix Container as it has become known in the industry is provided in at least two different capacities i.e. 48 ounces and 64 ounces for reconstituting 12 ounce and 16 ounce volumes of frozen concentrate as shown in Table I.

TABLE I

Types of Frozen Juices - Examples

| Juice | Concentrate Volume | Water Required | Total Mixed Volume |
|---|---|---|---|
| Minute Maid OJ | 12 oz | 36 oz | 48 oz |
| Seneca Grape Juice | 12 oz | 36 oz | 48 oz |
| Seneca Apple Juice | 12 oz | 36 oz | 48 oz |
| Welche's Apple/Grape/Cherry | 12 oz | 36 oz | 48 oz |
| Minute Maid Rasp. Lemonade | 12 oz | 52 oz | 64 oz |
| Minute Maid Lemonade | 12 oz | 52 oz | 64 oz |
| Minute Maid OJ | 16 oz | 48 oz | 64 oz |

Of course, a similar procedure can be utilized for reconstituting juice and flavored drinks from liquid concentrates which have become increasingly popular among consumers. Such liquid concentrates are sold in a cylindrical can approximating the dimensions of the frozen juice concentrate can 20.

Figure 2:
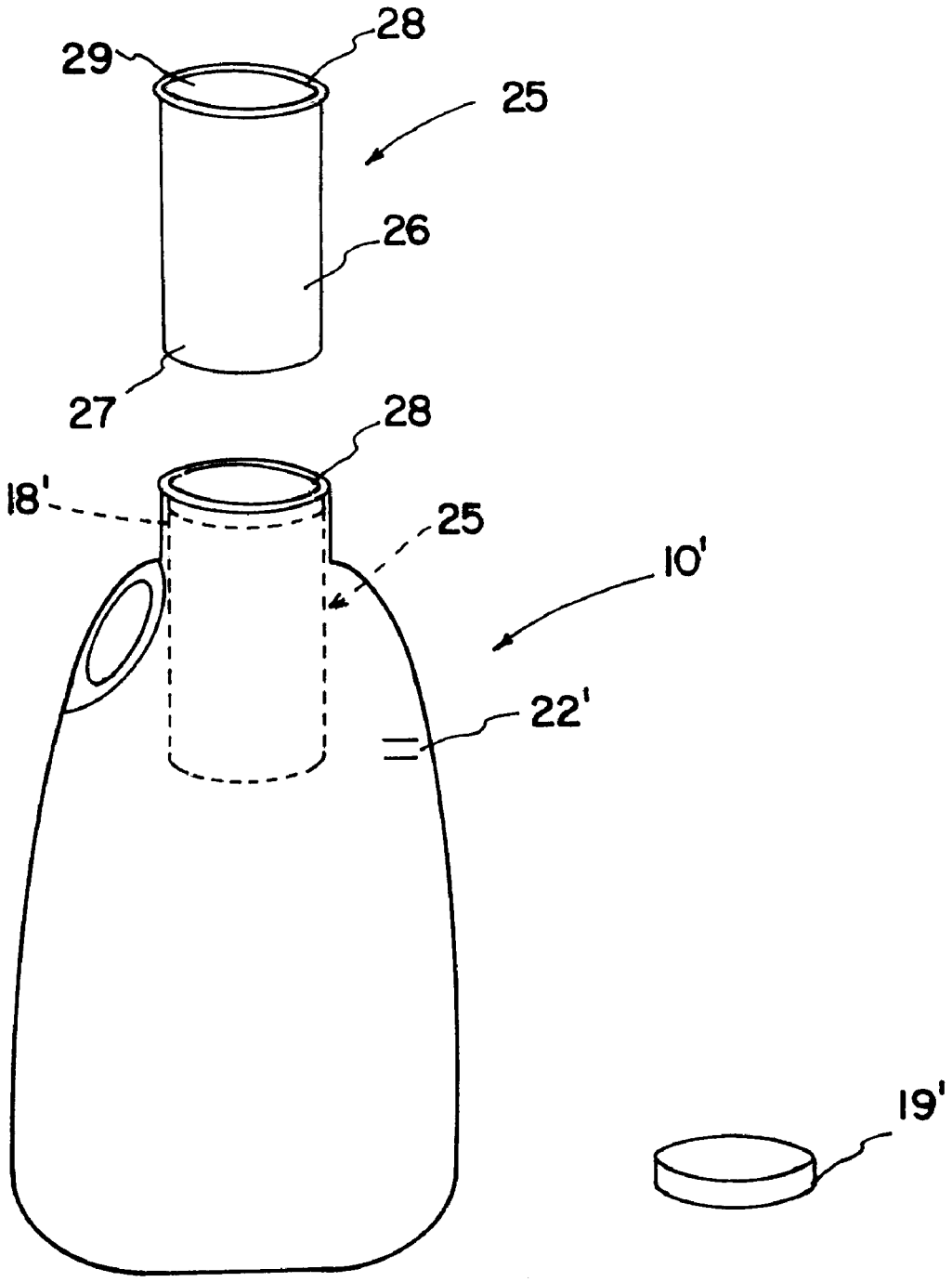
FIG. 2 is a perspective view of another embodiment of a bottled water container of the present invention including a cup-shaped insert.

In an alternative embodiment of the present invention a container 10' substantially identical to the container 10 illustrated in FIG. 1 is provided including a generally cylindrical cup insert 25 as shown in FIG. 2. The cup insert 25 is fabricated from a transparent plastic material having properties suitable for gas sterilization. The cup insert 25 includes a side wall portion 26, bottom surface 27 and a generally perpendicular shoulder portion 28 surrounding the end opening 29.

As described hereinabove in relation to the can 20, the cup insert 25 is insertable into the mouth opening 18' as shown in phantom outline in FIG. 2 and securable thereon by a cap 19'.

In this embodiment the cup insert 25 displaces an equivalent volume to the volume of concentrate i.e. (12 oz's or 16 oz's) as shown in Table I.

The cup insert 25 ensures that a predetermined volume is reserved within the container 10' to accommodate addition of the frozen concentrate when the cup insert 25 is removed prior to mixing and gives the appearance of a filled container.

Figure 3:
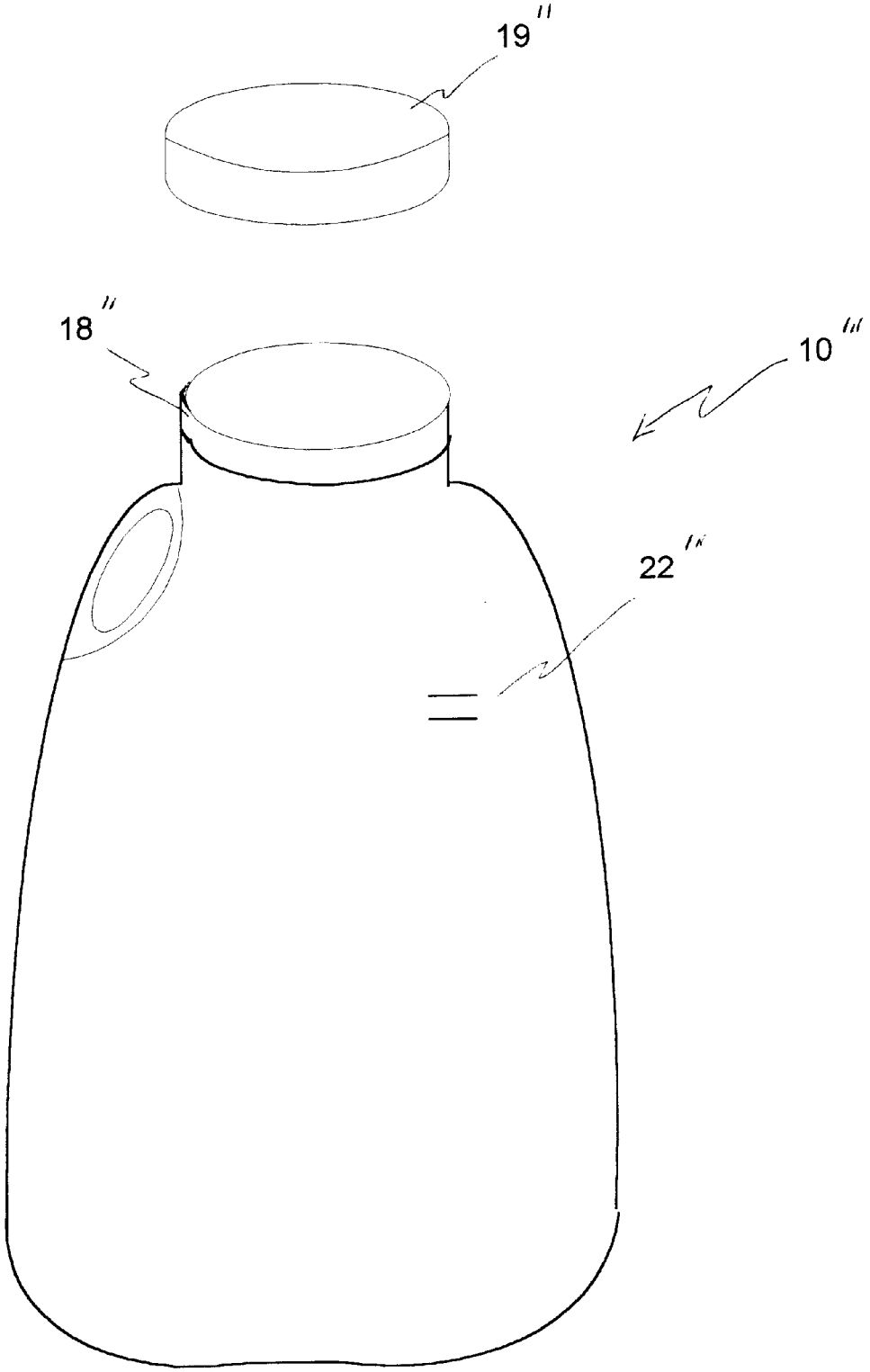
FIG. 3 is a perspective view of yet another embodiment of a bottled water container of the present invention with wide-mouth opening.

In yet another alternative embodiment of the present invention the container 10" is provided as shown in FIG. 3 to facilitate the reconstitution of powdered drink concentrates. In this embodiment the Ready Mixed Container 10" is constructed with a so-called wide mouth opening 18" having an even larger diameter than the containers previously disclosed. The wide-mouth opening 18" provides for convenient transfer of the powdered drink concentrate usually accomplished with a spoon or small scoop (not shown).

This embodiment of the container 10" includes at least three different capacities i.e. 32 oz, 64 oz, and 128 oz for reconstituting the powdered concentrates of different manufacturers as shown in Table II.

TABLE II

| Mixer | Mix Added | Water Required |
|---|---|---|
| Kool-Aid | 5 oz | 64 oz |
| Gatorade | 18.4 oz | 256 oz |
| | 9 oz | 128 oz |
| | 4.5 oz | 64 oz |
| | 2.2 oz | 32 oz |
| Country Time Lemonade | 20 oz | 256 oz |
| | 10 oz | 126 oz |
| | 5 oz | 64 oz |
| | 2.5 oz | 32 oz |
| Nestea Ice Tea | 20 oz | 128 oz |
| | 10 oz | 64 oz |
| | 5 oz | 32 oz |

As in the hereinabove described embodiments, the present wide-mouth container 10" is also provided with indicia 22" to indicate the proper volume of water to be mixed with the prescribed amount of powdered drink concentrate to produce a reconstituted drink which fills the container 10" to capacity.

To use the container 10 shown in FIG. 1, the cap 19 is unsealed and removed and an open can 20 of frozen juice concentrate is placed in the mouth opening 18 with the opened end down. As the concentrate thaws it flows downward through the opening 18 into the body portion 12 due to gravity.

After sufficient time has elapsed and the contents have drained out, the can 20 is removed and the cap 19 replaced over the opening 18.

If additional mixing is required, the cap 19 is replaced and the full container 10 is agitated and the reconstituted juice is ready to serve or to be placed in the refrigerator.

In order to use the embodiment of the container 10' shown in FIG. 2, the cap 19' is unsealed and removed from the container.

Thereafter, the cup insert 25 is removed from its position shown in phantom outline in FIG. 2.

Next, a can 20 of frozen concentrate is placed in the opening 18' with the opened end down. Similarly, after sufficient time has elapsed and the concentrate has drained into the container, the empty can 20 is removed and the cap 19' is replaced.

If additional mixing is needed, the container 10' is again agitated and the reconstituted juice is ready to serve or to place in the refrigerator.

It will be noted that in this embodiment the cup insert 25 is provided to give the appearance of a full container 10' on the store shelf which may impart more visual appeal to the product. The cup insert 25 may be utilized for advertising purposes by insertion of printed or graphic advertising material (not shown) within the opening 29 and directed outwardly against the inner surface of the transparent side wall 26. For example, the distributor of the container 10' may choose to advertise frozen juice concentrate of a specific manufacturer compatible with the present container system.

To use the container 10" shown in FIG. 3, the consumer again unseals the cap 19" and adds the prescribed amount of a powdered or granulated drink concentrate into the wide mouth 18" as directed. Mixing proceeds by insertion of a stirring utensil into the container 10" or by replacing the cap 19" and agitating the container.

From the above it can be seen that the bottled water container system of the present invention and its method of use provides for convenient thawing and mixing of frozen juice and powdered drink concentrates. The present system provides bottled water from an identifiable commercial source for admixture to a frozen, liquid, or powdered juice concentrate. The present container system and method of use provides the consumer with a reconstituted juice or fruit drink of a consistent taste and quality.

The terms "inner", "outer", "side" and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A method of reconstituting drink concentrate carried in a cylindrical concentrate container having a removable cover, the drink concentrate having a concentrate volume for combination with a water volume to provide a reconstituted drink, said method comprising the steps of:

a. providing a mixing container having an internal volume at least equal to said concentrate volume and said water volume, said mixing container including a mouth at the top thereof communicating with said internal volume, said mouth configured and dimensioned to slideably receive said concentrate container within said internal volume and reside therein;

b. partially filling said internal volume of said mixing container with water from an identifiable commercial source in the amount of said water volume and sealing said partially filled container by covering said mouth with a reseable watertight cap to form a bottled water;

c. selecting from a plurality of sources said concentrate container with concentrate in said concentrate volume and removing said cover to provide an open end;

d. removing said watertight cap from said bottled water to expose said mouth;

e. slidably inserting said open end and said concentrate container containing concentrate through said exposed mouth and into said internal volume of said partially filled container;

f. maintaining said concentrate container in said internal volume of said partially filled container until said concentrate leaves said concentrate container into said water volume; and then g. mixing said bottled water with said concentrate in said previously partially filled container to provide a reconstituted drink.

2. The method as recited in claim 1 including providing an insert having a shape and a volume replicating said concentrate container, inserting said insert through said mouth into said interior volume after the filling recited in step (b), and removing said insert prior to said inserting recited in step (e).

* * * * *